US005473123A

United States Patent [19]

Yazici et al.

[11] Patent Number: 5,473,123

[45] Date of Patent: Dec. 5, 1995

[54] AIR HANDLING STRUCTURE FOR FAN INLET AND OUTLET

[75] Inventors: Muammer Yazici, Mississauga; Werner Richarz, Ottawa, both of Canada

[73] Assignee: Dipti Kr. Datta, Mississauga, Canada

[21] Appl. No.: 179,183

[22] Filed: Jan. 10, 1994

Related U.S. Application Data

[62] Division of Ser. No. 72,590, Jun. 4, 1993, Pat. No. 5,426, 268.

[51] Int. Cl.[6] ..... E04F 17/04

[52] U.S. Cl. ..... 181/224

[58] Field of Search ..... 181/217, 218, 181/224, 225, 229, 258, 268, 270, 281, 282

[56] References Cited

U.S. PATENT DOCUMENTS

| | | | |
|---|---|---|---|
| 2,916,101 | 12/1959 | Naman | 181/224 |
| 2,994,401 | 8/1961 | Bourne et al. | 181/224 |
| 3,018,840 | 1/1962 | Bourne | 181/224 |
| 3,094,189 | 6/1963 | Dean | 181/259 |
| 4,287,962 | 9/1981 | Ingard et al. | 181/224 |
| 4,295,416 | 10/1981 | Gorchev et al. | 181/224 X |
| 4,316,522 | 2/1982 | Hirschorn | 181/224 |
| 4,319,521 | 3/1982 | Gorchev | 181/224 X |
| 4,336,863 | 6/1982 | Satomi | 181/224 |
| 4,418,788 | 12/1983 | Gorchev et al. | 181/224 |
| 4,986,170 | 1/1991 | Ramakrishnan et al. | 181/224 X |

FOREIGN PATENT DOCUMENTS

| | | |
|---|---|---|
| 1133313 | 10/1982 | Canada . |
| 1317503 | 5/1993 | Canada . |
| 1423986 | 2/1976 | United Kingdom . |

*Primary Examiner*—Khanh Dang
*Attorney, Agent, or Firm*—Baker & Daniels

[57] ABSTRACT

Combined air duct apparatus and silencer for attachment to both the inlet and the outlet of a fan unit for a building wherein each silencing apparatus has an exterior housing with an air inlet and an air outlet, one of which is adapted for connection to the fan unit. The inlet and outlet are connected by an airflow passageway defined by interior walls of the housing. A resonator chamber for reducing noise created by the fan unit extends around or is adjacent to the inlet or the outlet that is connected to the fan unit. The chamber is enclosed by chamber walls including a peripheral wall perforated with a number of holes and facing the airflow passageway. First and second series of splitters are also provided with those in each series being spaced apart to form smaller air passageways and mounted side-by-side in a row. The second series is positioned downstream of the first series. In the outlet duct unit, the air inlet is preferably circular while the outlet is rectangular. An internal wall provides a gradual transition in the transverse cross-section of the main passageway. An imperforate diffusing baffle plate member can also be mounted in the airflow passageway to provide uniform air distribution at the outlet.

18 Claims, 8 Drawing Sheets

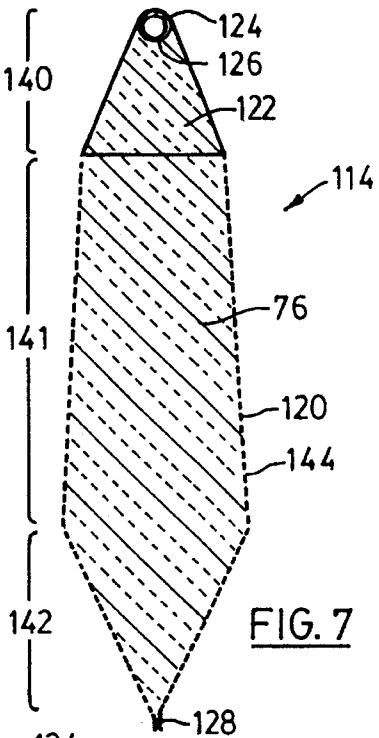
FIG. 7
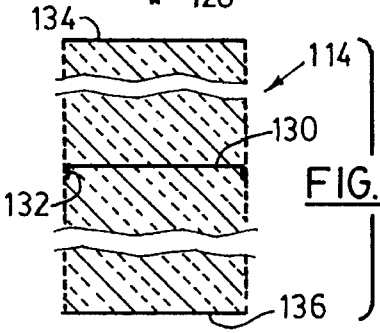
FIG. 8
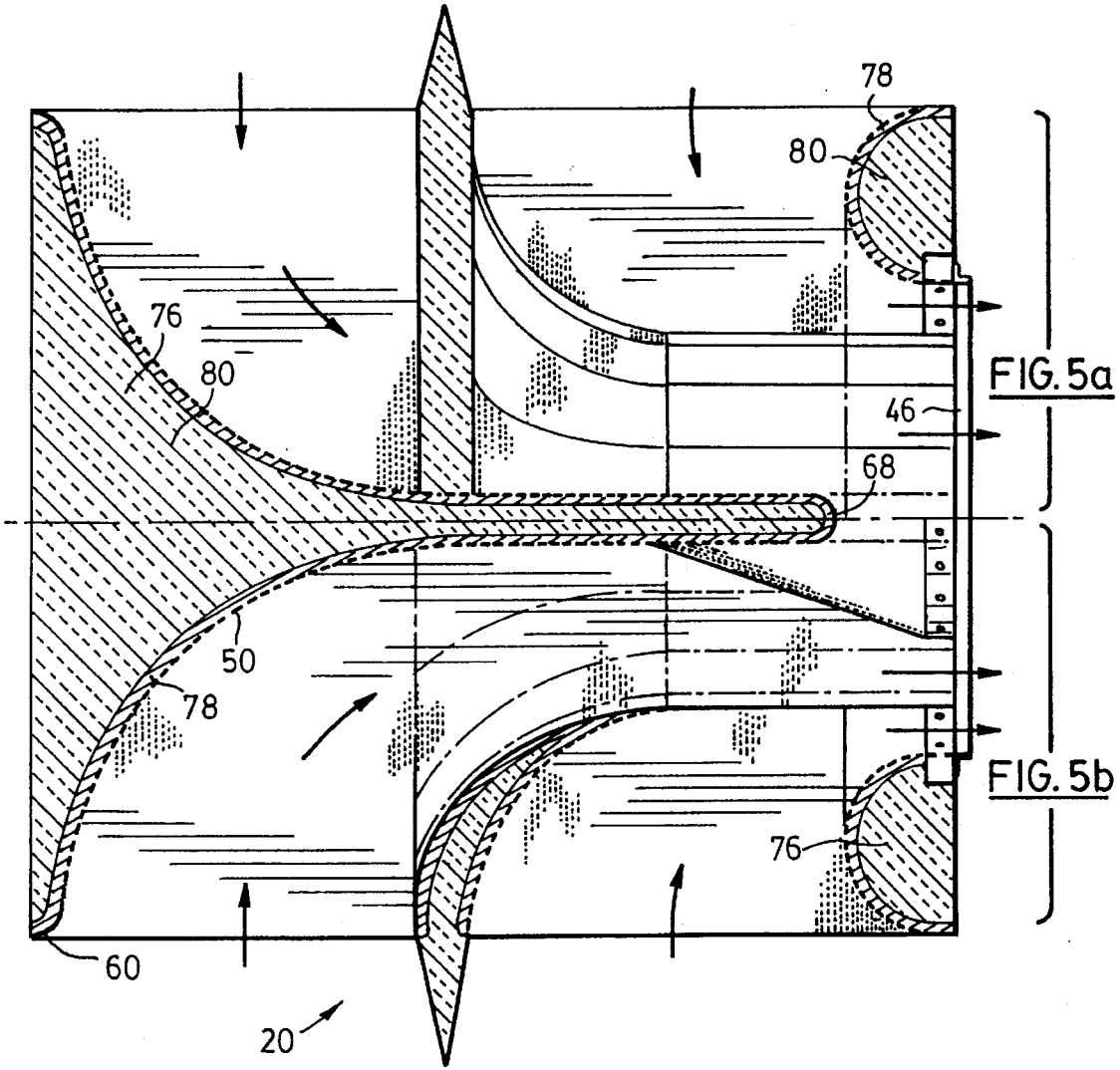

AIR HANDLING STRUCTURE FOR FAN INLET AND OUTLET

This is a division of application Ser. No. 08/072,590, filed Jun. 4, 1993 now U.S. Pat. No. 5,426,268.

BACKGROUND OF THE INVENTION

This invention relates to air duct apparatus for use in conjunction with air supply fan units, particularly such units designed for buildings or other large structures.

It is well known to provide an air supply system for a building, which system includes a main air supply duct, branch supply ducts and a fan unit. Often an air conditioning unit will form part of this system in order to cool the air that is being forced through the ducts. A problem often encountered with such systems is that the fan unit can produce a substantial noise and this noise can be carried through the ductwork and thereby be heard by persons in the building or structure. Not only is this a problem downstream of the fan unit, but it can also be a problem, at least in the immediate vicinity of the fan unit, on the upstream side since sound can travel out through the passageways that feed air to the fan unit. The noise created by the large fans in these systems is a particular problem in those buildings which must or should be kept reasonably quite, for example in hospitals and other buildings where the occupants are sleeping on a regular basis.

In addition to providing some noise attenuation, an air duct structure located downstream from a fan unit often is required to deliver the airflow from the fan to one or more air filters or perhaps to an air conditioning unit. In such cases it can be important for the air stream provided at the outlet of the duct structure to be relatively uniform across the width and height of the outlet. In this way, the amount of air flowing through each filter or each section of the filter, would be approximately the same.

In the construction of the duct structure located immediately downstream from a fan unit, it can be advantageous if the size of the air flow passageway is gradually increased from the inlet to the outlet of the duct structure. By increasing the size of the passageway in this manner, the air flowing through the passageway is allowed to expand gradually, thus permitting the velocity energy of the air to be recovered. As a result, the static pressure of the airflow is thereby increased. A gradual expansion of the size of the passageway is important in order to obtain maximum regain of air velocity pressure. By constructing the outlet duct structure in this manner, one could use a smaller size of fan motor to supply the same size of building than would otherwise be the case.

Another requirement of the duct structure located downstream from an air supply fan unit, is the frequent need to convert the airflow passageway from one having a round cross section at the outlet of the fan unit to one having a rectangular cross section. It will be appreciated that a rectangular air supply duct generally provides a more efficient use of the space available in a building for such ducts. Accordingly, it is often a requirement in a building that the air supply ducts and particularly the main ducts be substantially rectangular or square. The distance available to a duct designer or an air duct supplier for making this transition from a round cross-section to a rectangular one will vary from one job site to the next but, at least for some building sites, the transition distance can be quite short.

U.S. Pat. No. 4,418,788 issued Dec. 6, 1983 to Mitco Corporation describes a combined branch take-off and silencer unit for an air distribution system. This combined apparatus has two series-coupled sections, the first being a static pressure regain section and the second section having a main airflow passageway extending along its centre axis and branch ducts which connect smoothly with the main passageway. The structure is constructed with internal walls made of perforated metal sheets which overlays fibreglass packing provided for sound absorption. The main duct in this apparatus has a circular cross-section.

U.S. Pat. No. 4,295,416 issued Oct. 20, 1981 to Mitco Corporation describes a building air distribution system with a mixing plenum for receiving and mixing outside and return air. There is an input flow concentrator and integral silencer disposed within the plenum. The output port of this unit is connected to a fan unit which drives the air to the main duct of the building. The concentrator/silencer has inner and outer sections which are axially symmetrical about a vertical axis. It has an input port which extends symmetrically about this axis and a circular output port at the top. The inner and outer sections are lined with acoustically absorbing material.

U.S. Pat. No. 4,986,170 dated Jan. 22, 1991 issued to the present applicant describes a branch take-off airflow device which can be used immediately downstream of a fan unit. In the take-off section of the unit, the take-off passageways are rectangular in transverse cross-section whereas the main airflow passageway extending axially through the unit has a circular cross-section. In this main passageway there is an elongate airflow defining member which has a round, transverse cross-section with a maximum diameter equal to the diameter of the hub of the adjacent fan.

British patent No. 1,423,986 in the name of Alan Dodson et al, published Feb. 4, 1976, describes a silencer duct designed for use in a roof opening where an extractor fan is located above the opening. Opposite sidewalls of the duct are lined with sound absorbing material such as glass fibre slabs. Additional silencing is provided in the form of flow-splitter baffles which are flat and parallel to each other. This duct unit has a rectangular cross-section. The baffles themselves contain sound absorbing material.

It is an object of the present invention to provide improved air duct structure for both the inlet and the outlet sides of an air supply fan unit for a building or other large structure. Both the inlet and the outlet apparatus are provided with improved sound attenuating capabilities.

It is another object of the invention to provide a resonator mechanism for reducing the narrow band peak noise generated by the fan blade passages, which mechanism includes a hollow resonator chamber extending around or located adjacent to the inlet or the outlet that is connected to the fan unit.

It is a further object of the invention to provide an inlet duct apparatus or an outlet duct apparatus having at least first and second series of splitters with the splitters of each series being spaced apart to form smaller air passageways and mounted side-by-side in a row. The second series is positioned downstream in the airflow passageway relative to the first and is staggered with respect to the first series. In addition to improved sound attenuation, these splitters promote the regain of air velocity pressure in the unit.

SUMMARY OF THE INVENTION

According to the invention, a sound attenuating duct unit suitable for placement at an outlet or an inlet of an air supply fan unit for a building or other large structure includes a housing having side walls surrounding a main airflow passageway, a circular air inlet at one end thereof, and a rectangular air outlet in one of the side walls or at an end of the housing opposite said one end. The air inlet or the air outlet of the housing is respectively adapted for placement next to the outlet or the inlet of the fan unit. An internal wall of the housing provides a gradual transition in the transverse cross-section of the main air flow passageway from circular to rectangular. At least first and second series of splitters are provided and the splitters of each series are spaced apart to form smaller air passageways and are mounted side-by-side in a row. The second series is positioned downstream in the air flow passageway relative to the first series and is staggered relative to the first series in a direction generally transverse to the direction of air flow in the main passageway. These splitters contain sound attenuating material.

Preferably the rectangular air outlet is substantially larger than the circular air inlet.

According to still another aspect of the invention, a duct unit for placement at an outlet of an air supply fan unit for a building or other large structure includes a housing having side walls surrounding a main airflow passageway, an air inlet at one end thereof for arrangement next to the outlet of the fan unit, and an air outlet in a side or opposite end of the housing. The airflow passageway gradually increases in transverse cross-section from the air inlet to the air outlet so that the air outlet is substantially greater in size than the air inlet. A diffusing baffle device is rigidly mounted in the airflow passageway to provide more uniform air distribution to the air outlet. The diffusing baffle device is made of imperforate metal plate and extends about a centreline of the airflow passageway. The diffusing baffle acts to reduce the angle of expansion of air flowing through the main passageway.

Preferably the diffusing baffle device has a gradual change in its transverse cross-section from round at an upstream end to rectangular at an opposite downstream end.

In the preferred embodiment of the air duct outlet apparatus, there is a central airflow defining member rigidly mounted in the housing in the airflow passageway. This member extends to the inlet adapted for connection to the fan unit and creates an airflow passageway that is annular at the inlet. There can be a resonator chamber located at the upstream end of this airflow defining member and surrounded by the annular passageway.

Further features and advantages will become apparent from the following detailed description taken in conjunction with the accompanying drawings which illustrate preferred embodiments of the invention.

BRIEF DESCRIPTION OF THE DRAWINGS

FIG. 5*a* is one half of a composite section of the air duct inlet structure taken along the line Va—Va of FIG. 4;

FIG. 5*b* is the other half of the composite section of the air duct inlet structure taken along the line Vb—Vb of FIG. 4 showing the flat floor of the upper section and in chain dot lines the outline of the passageway above the plane of the section;

FIG. 7 is a detail view of the transverse cross-section of a typical splitter used in the air duct outlet structure of the invention;

FIG. 8 is a detail view, with sections removed, of the splitter of FIG. 7, which view shows an inner horizontal plate support;

DETAILED DESCRIPTION OF PREFERRED EMBODIMENTS

Figure 1:
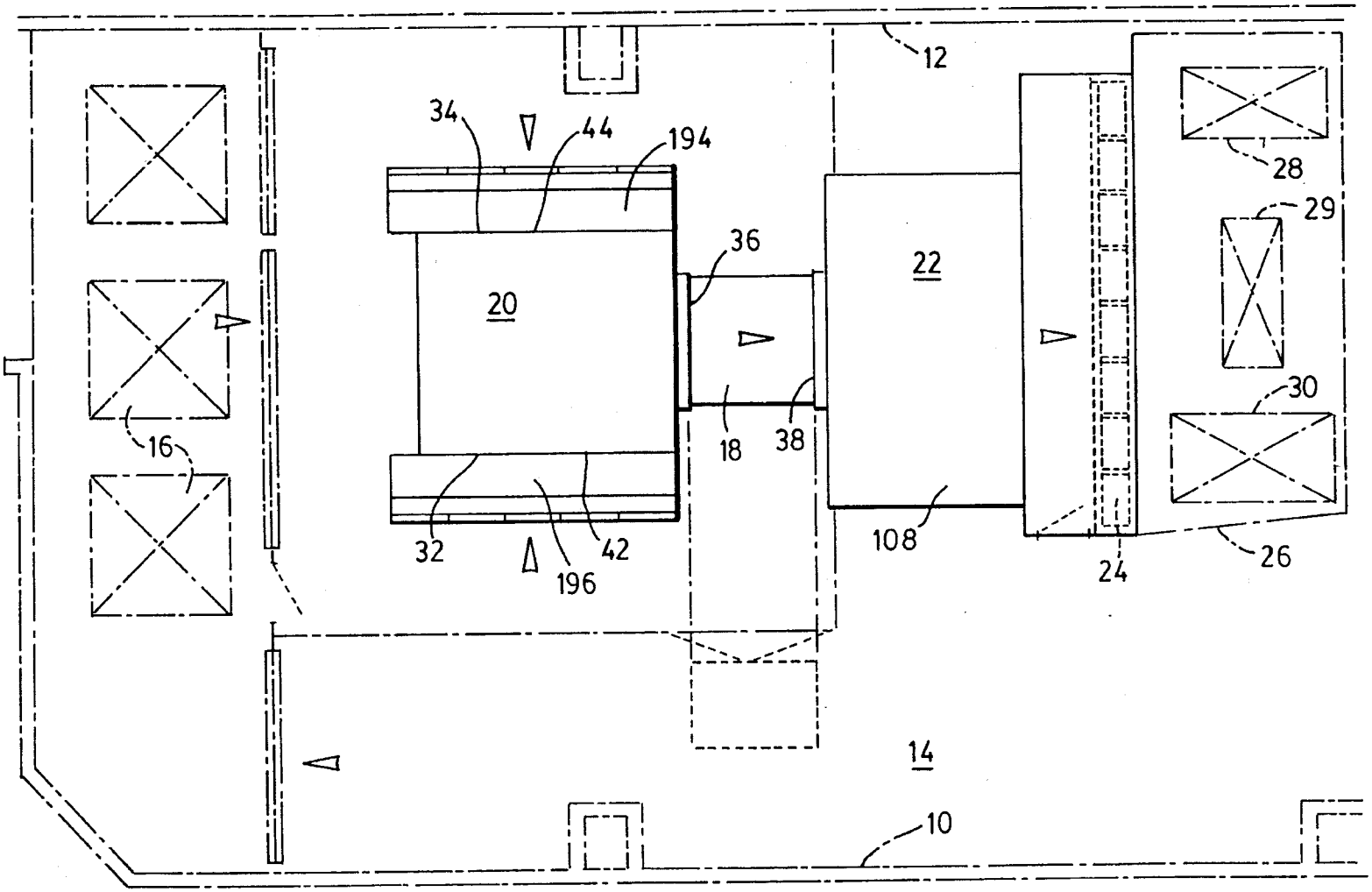
FIG. 1 is plan view of a typical equipment room in a building wherein air duct silencing apparatus constructed in accordance with the invention have been installed.

FIG. 1 illustrates a typical equipment room constructed to house the air supply equipment for a building or other large structure. Outlined in dashed lines are the walls 10 and 12 of this room 14. Located at one end of the room and also indicated in dashed lines are three inlets 16 which supply outside air to the room and to the air supply equipment. Centrally located in the room and preferably accessible for removal or repairs is an air supply fan unit 18 which drives the air from a combined air duct inlet apparatus and silencer 20 to a combined air duct outlet apparatus and silencer 22. It will be understood that both the air duct inlet apparatus 20 and the air duct apparatus 22 incorporate at least one aspect of the present invention. The fan 18 itself can be of standard construction and the unit 18 per se does not form part of the present invention.

In the preferred arrangement shown, the outlet apparatus 22 supplies air to a bank of or series of air filters 24 through which the air flows to a rectangular plenum 26 shown in dashed lines and possibly to several smaller, rectangular supply ducts 28 to 30. Alternatively, the outlet apparatus 22 may supply air directly to a large rectangular supply duct.

It will be understood that incoming air enters the duct inlet apparatus 20 from opposite vertical sides 32 and 34 and accordingly these sides should be spaced an adequate distance from the walls of the room, for example four to five feet. It will also be understood that the standard fan unit 18 has a circular air inlet at the end 36 of the unit and a circular air outlet at its downstream end 38. Accordingly, the outlet for the air duct apparatus 20 and the inlet for the air duct outlet apparatus 20 are also circular and preferably of corresponding size.

Figure 2:
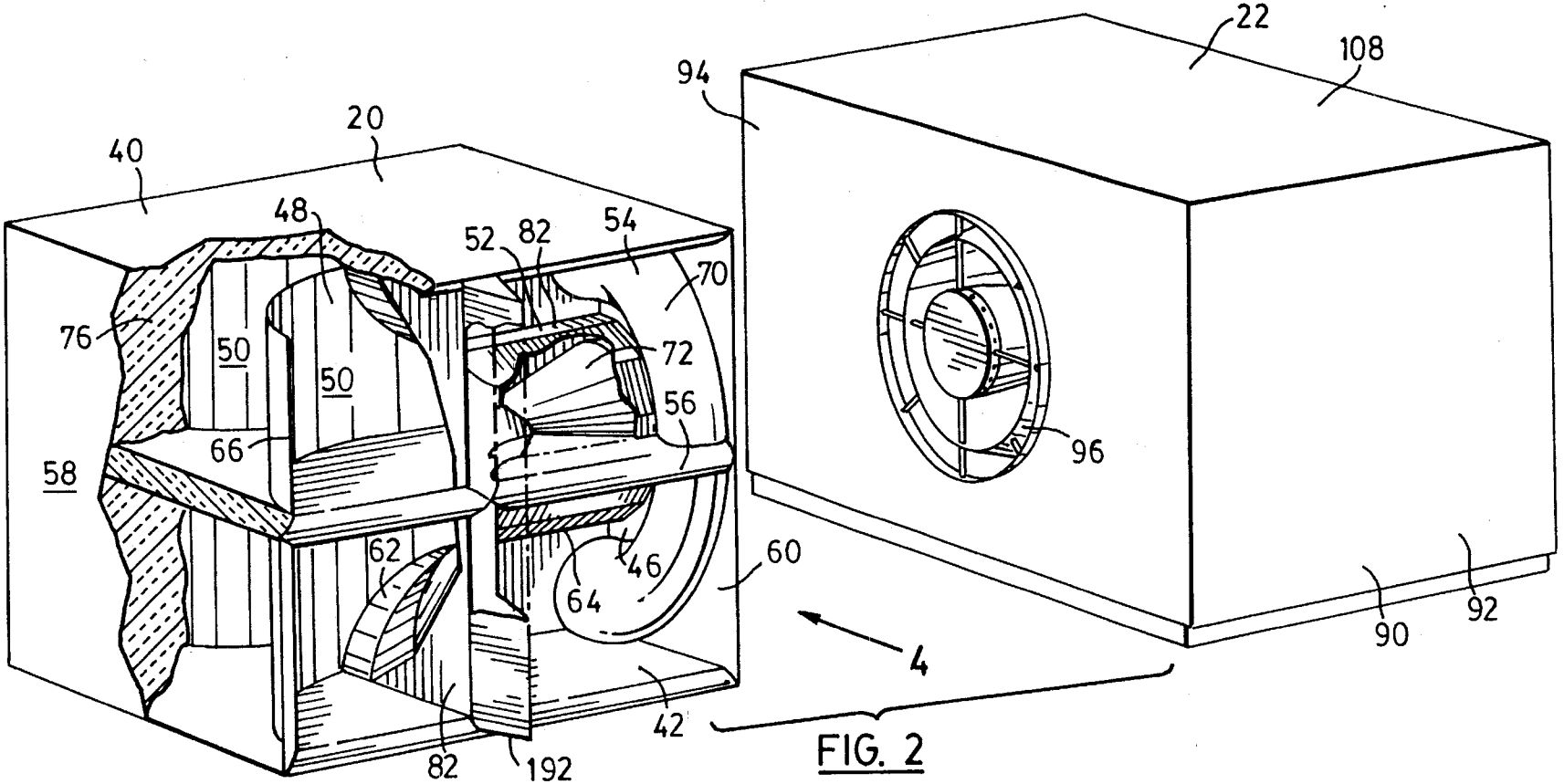
FIG. 2 is a perspective view showing vertical sides and the top of both an air duct inlet structure and an air duct outlet structure constructed in accordance with the invention and in approximate relationship.
Figure 3:
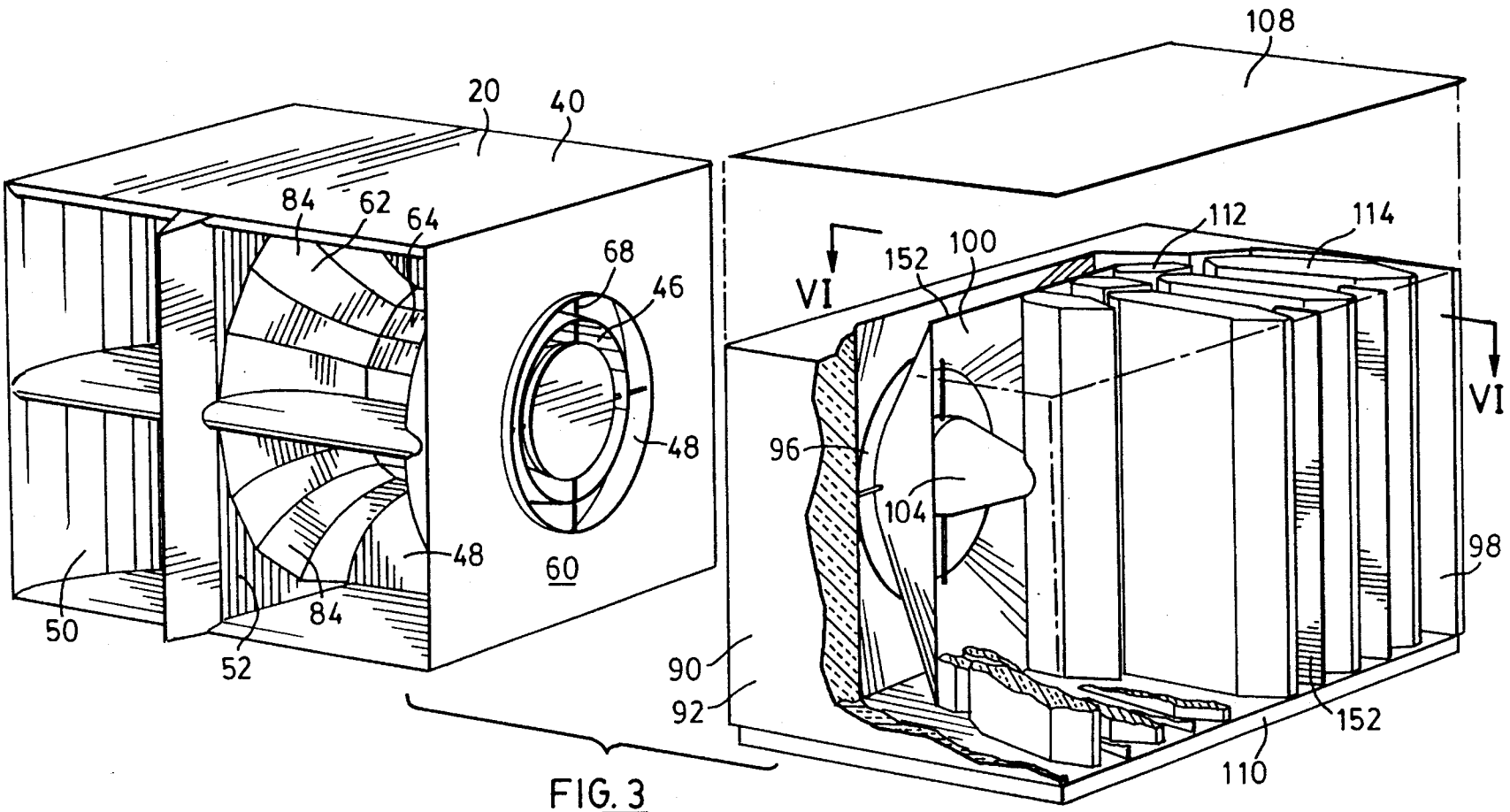
FIG. 3 is another perspective view showing the outlet ends of the air duct inlet structure and the air duct outlet structure of FIG. 2 in which the top panel of the outlet structure has been exploded and in which the outlet structure is broken away for purposes of illustration.

Referring now to FIGS. 2 and 3 of the drawings, the duct inlet apparatus 20 includes an exterior housing 40 having two principal air inlets 42 and 44 located at sides 32 and 34 respectively, that is on opposite vertical sides. This unit also has a single annular air outlet 46 located at one end of the housing and adapted for connection to the fan unit for air flow to the latter. The air inlets 42 and 44 and the outlet 46 are connected by an airflow passageways 48 defined by interior walls 50, 52 and 54, which passageways curve about 90 degrees from the inlets to the outlets. At least sections of these walls are preferably made of perforated sheet metal to provide sound attenuation. Preferably the air passageway extending from each inlet is divided into four quadrants as illustrated but with larger units more than four segments for the inlet on each side can be constructed. The upper and lower quadrants are separated by a horizontal divider 56 which extends from a front wall 58 to rear wall 60. The left and right quadrants are separated by the aforementioned interior wall 52 which is shaped like one half of a funnel in the passageway. It thus has a curved section 62 which extends to a semi-cylindrical section 64. The interior wall 50 is a vertical wall that is curved in plan view. Its leading edge 66 is located at the front wall 58 while its rear edge 68 is located near the outlet 46 as shown in FIGS. 5*a* and 5*b*.

With respect to interior wall 54, it forms an annulus at 70 which is semi-circular in cross-section. The purpose of this annulus is to help smooth the flow of air into the fan unit and to help avoid a direct line of sight from the inlet of the fan unit through the passageway 48. Because the sound is unable to pass directly from the front of the fan to the interior of the room 14, the amount of noise is reduced.

The duct inlet apparatus is also provided with a central airflow defining member in the form of conical plate 72, which plate is rigidly mounted in the housing in the airflow passageway 48. The wide end of this member is located at the outlet 46. With this conical plate, which is also made of perforated metal and contains sound absorbing material, and the internal walls 50 and 54, the two airflow passageways 48 join and form an annular passage at the outlet 46 (see FIG. 3). Thus, the shape and size of the combined passageway at this outlet corresponds to the shape and size of the inlet (not shown) of fan unit 18.

In order that the duct inlet apparatus 20 will also act as a silencer, the housing contains sound absorbing material, which material is indicated generally at 76. The sound absorbing material extends to and is covered by the internal walls 50, 52 and 54. In preferred embodiments of both the duct inlet apparatus 20 and the outlet apparatus 22 there are at least two types of sound absorbing material used. The first type is the relatively thin layer, for example, one half inch, of fibreglass insulation which has a cloth backing. A suitable form of this insulation indicated at 78 in FIGS. 5*a* and 5*b* is Knauf Ductliner-M. This material has zero erosion of the fibreglass insulation at air velocities up to 6,000 feet per minute. Because of this zero erosion characteristic it is placed directly against the back of the perforated metal plate which forms the interior walls of the duct/silencer with the cloth backing lying against the perforated sheet metal. Behind the material 78 is placed standard low density acoustical filler 80 which is used to fill the remainder of the cavity between the internal walls and the exterior walls of the housing. For example, this standard fibreglass acoustical filler can be purchased in the form of bats that are 3 inches thick and when placed in the duct/silencer it is compressed to some extent (for example from 3 inches to 2 inches in thickness) in order that it will completely fill the space and have good sound absorbing capabilities.

In a preferred embodiment of the apparatus 20, only a portion of the internal wall 52 is made of perforated metal sheet. In fact, all of the side of wall 52 that faces the internal wall 50 and the conical plate 72 is made of imperforate galvanized metal sheet (for example 16 gauge). The imperforate sheet metal is indicated at 82. Only the curved portion of internal wall 52 which faces the internal wall 54 is constructed of perforated metal sheet, typically 22 gauge. This perforated sheet is indicated at 84 in FIG. 3. The reason for the use of the two different sheet materials is that the perforated sheet is only used where there is room for sound absorbing material to be placed behind the metal sheet.

It will also be appreciated by those skilled in this art that the apparatus 20 could also be used as a duct outlet apparatus/silencer for placement immediately downstream of the fan unit, if desired. Such a use would provide enhanced sound attenuation as well as uniform air delivery to the two outlets of the duct unit.

Reference will now be made to the main components and structure of the duct outlet apparatus/silencer 22 which is connected to the outlet side of the fan unit 18. The duct apparatus 22 includes an exterior housing 90 with sidewalls 92, a front end wall 94 containing an air inlet 96 and a rectangular air outlet 98. The inlet 96 and the outlet 98 are connected by a main airflow passageway 100 defined by interior walls 102 of the housing (see FIG. 6).

The duct apparatus 22 contains a central airflow defining member 104 which is rigidly mounted in the housing in the passageway 100. This conical member 100 tapers and extends from the region of the inlet 96 to a centrally located splitter 106 described further hereinafter. Thus, between the member 104 and the interior wall 102, the passageway 100 is substantially annular. The member 104 is filled with sound absorbing material in the manner described above in connection with the inlet apparatus 20. This sound absorbing material also fills the space behind interior walls 102 and surrounds the passageway 100. In the outlet duct apparatus 22 the main passageway 100 is shown as substantially straight although the passageway increases in transverse cross-section from the inlet to the outlet. However, it will be appreciated that an outlet duct apparatus constructed in accordance with the inlet to the outlet. However, it will be appreciated that an outlet duct apparatus constructed in accordance with the invention can be made with a curved main passageway that, for example, curves about 90 degrees from the air inlet to the air outlet. In this case the outlet of the unit would be at a side of the housing rather than at the end thereof which is opposite the end wall 94. The air inlet 96 corresponds substantially in size and shape to the outlet (not shown) of the fan unit 18.

Figure 6:
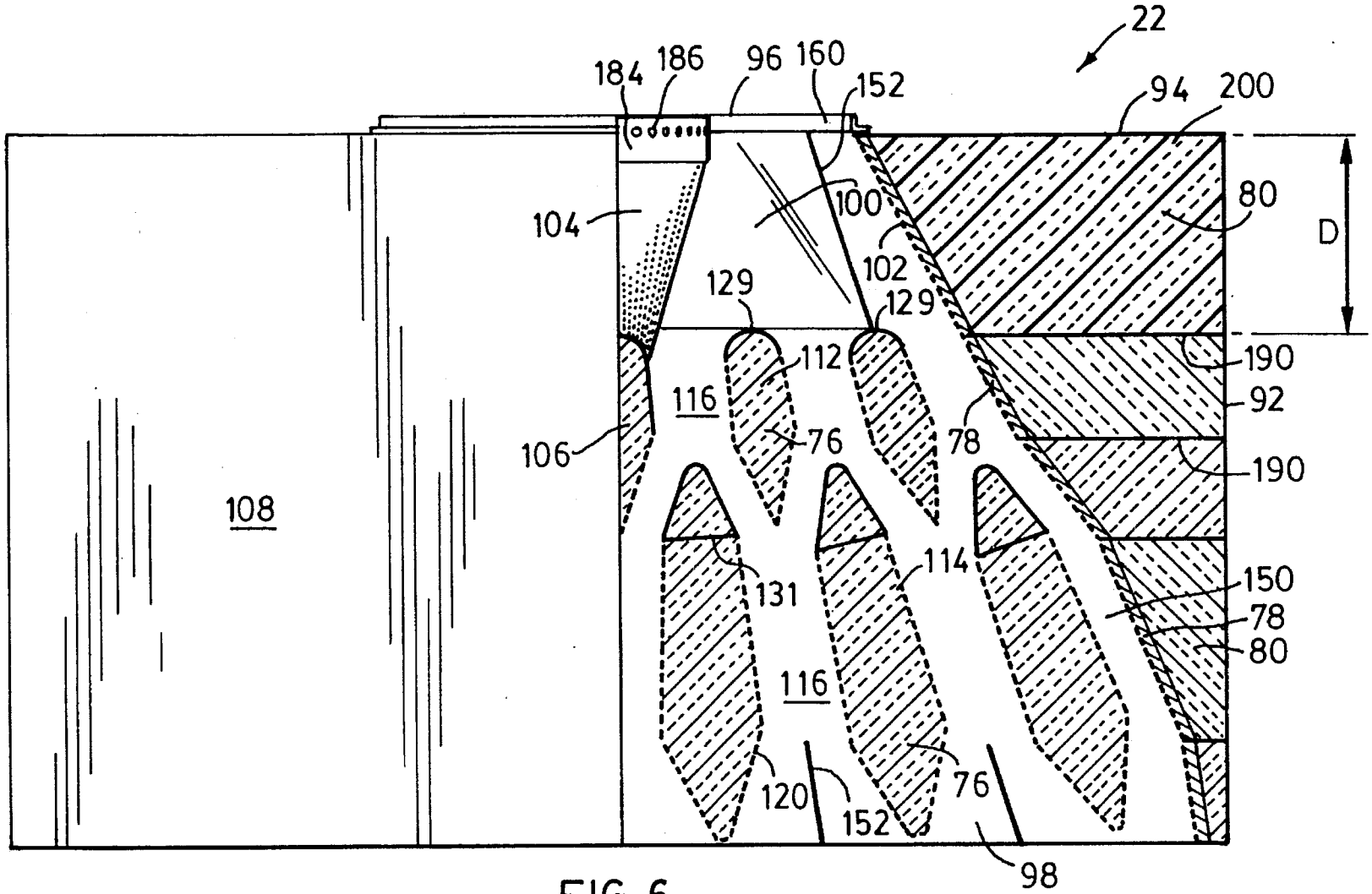
FIG. 6 is a plan view of an air duct outlet structure constructed in accordance with the invention with one half of the view in cross-section along the line VI—VI of FIG. 3.

The outlet apparatus 22 has a top sidewall 108 and a bottom sidewall 110. Between these two walls or panels extend at least first and second series of air stream splitters 112 and 114 with the splitters of each series being spaced apart to form smaller air passageways 116. The splitters of each series are mounted side-by-side in a row as shown in FIGS. 3 and 6 with the second series comprising the splitters 114 positioned downstream in the airflow passageway 100 relative to the first series comprising the splitters 112. Also, the splitters 114 are staggered relative to the first series transverse to the direction of air flow in the passageway. In this way there is no direct line of sight from the inlet 96 to the outlet 98, thus preventing sound waves from travelling directly from the inlet to the outlet. This is due in part to having the width of the splitters correspond closely to the width of the passageways 116 between the splitters of the other series.

The construction of each splitter will now be discussed in detail with references to FIGS. 3, 6, 7 and 8. Each splitter 112 and 114 contains sound absorbing material 76. Again, this material can comprise the two types of fibreglass material described above in connection with inlet apparatus 20. Each splitter is a straight elongate member which extends vertically substantially the entire height of the outlet duct apparatus 22. Each splitter is formed with perforated sheet metal 120 which covers the sound attenuating or sound absorbing material 76 contained in the splitter. Preferably the fibreglass insulation in the nose area 122 is packed to a higher density to improve the sound attenuating characteristics of the splitter. In the illustrated preferred embodiment the nose area is packed with acoustical filler to a density of 1.6 lbs per cu. ft. while the remainder of the splitter is packed with the same filler to a lower density of only 1.2 lbs per cubic foot. The nose section 122 including the rounded nose 124 which forms the upstream end is made of imperforate metal. The nose 24 is preferably a length of metal tubing 126 (for example, 2 inch outer diameter tubing). In one preferred embodiment, the total depth of the splitter from the nose 124 to tail end 128 is 45 inches while the depth of the splitter 112 is 25 inches. In this version, the splitter 114 has the maximum width of 12 inches while the corresponding splitter 112 has a maximum width of 8 inches. Also, as shown in FIG. 6, the nose portion of each splitter 112 is semi-circular in cross-section and is more rounded than the nose area of each splitter 114. The nose area 129 can be made from imperforate 18 gauge galvanized sheet metal that is welded to the perforated metal forming the sides of each splitter 112. The use of imperforate metal in the nose region has distinct advantages in that it reduces air friction at the region of impact of the air flow with the splitter and it helps maintain airflow speed through the duct unit. Optionally one can provide an internal partition wall 131 that separates the nose area from the rest of the splitter. This plate extends the entire height of the splitter and acts to separate the two densities of filler material.

The number of splitters in each row and their geometry can vary based on the desired length, width, height and sound absorption capacity of the duct apparatus 22. Also, if the main airflow passageway bends from inlet to outlet, the splitters can also bend or curve in their transverse horizontal cross-section to match the curve of the passageway.

FIG. 8 illustrates how each splitter 112, 114 can be provided with one or more intermediate, horizontal support plates 130 which are welded to the exterior metal sheets by means of flanges 132. Each support 130 can, for example, be made of 18 gauge imperforate metal sheet. In addition to providing added strength, the support plates 130 help to support the sound absorbing material and prevent it from settling unduly. FIG. 8 also illustrates the use of imperforate top and bottom plates 134 and 136 which are used to connect the splitter to the top and bottom walls of the housing.

As shown in FIG. 7, the preferred splitter 114 has three sections moving in the direction of airflow through the duct unit. These include a short nose section 140, a larger central section 141 with flat opposing sidewalls, and a tapering tail section 142. This provides the splitter with a streamlined exterior that will not slow down the flow of air an undesirable amount. Preferably the sidewalls 144 diverge slightly in the direction of airflow.

It will be appreciated that the aforementioned internal walls 102 provide a gradual transition in the transverse cross-section of the main airflow passageway 100 from circular to rectangular, it being noted that the air inlet 96 has a circular periphery while the air outlet 98 is rectangular. This gradual transition takes place over a relatively short distance indicated by the letter D in FIG. 6 relative to the total front to back dimension of the outlet apparatus 22. for example, in one preferred version of the apparatus 22, the distance D is 2 feet whereas the total distance from end wall 94 to the outlet 98 is 7 feet. Accordingly, in the region of the air passageway where the splitters 112 and 114 are mounted, the passageway has a rectangular cross-section. The transverse cross-section of the passageway 100 gradually increases from the air inlet 96 to the air outlet 98 as shown, whereby the air velocity pressure of air flowing through the passageway is recovered. The rectangular air outlet 98 is substantially larger than the circular air inlet.

In addition to the function of sound attenuation, another function of the splitters 112 and 114 is to divide the airflow in the main passageway evenly across the width thereof. For this reason the splitters in each series are substantially evenly spaced apart as shown in FIG. 6 so as to create the smaller air passageways 116 between them, which are substantially equal in transverse width (as well as in height). Small outer passageways 150 have a width about one half the width of passageways 116 between the splitters 114. It will be understood that by having the splitters so arranged that they split the stream of air evenly at each series of splitters, one will achieve a substantially uniform air stream at the outlet 98 where the air is combined again into a single air stream. In this way the air stream will strike the air filters 24 evenly, thus causing the filters to operate with maximum efficiency and to have a longer operating life before cleaning or replacement. Also, a gradual expansion of the air flow in the duct apparatus 22 (as permitted by the splitters) results in maximum static pressure regain. The outlet duct apparatus 22 has the basic advantages of saving both space and energy, the space being gained by having the transition from circular to rectangular cross-section incorporated into the body of the silencer.

Preferably in the region of outlet 98 there are additional flat splitters 152. These can be made of flat, imperforate sheet metal connected at the top and the bottom to the housing (typically by welding).

Another advantageous feature of the present invention which is found in the outlet duct apparatus 22 is diffusing baffle means rigidly mounted in the airflow passageway 100 to provide more uniform air distribution at the air outlet 98. In the illustrated embodiment, the diffusing baffle means comprises a single baffle member 152 made of imperforate metal plate. In one preferred embodiment, the diffusing baffle member is made of 16 gauge galvanized sheet metal and has a length of about 2 feet, the same as the length of the gradual transition from circular to rectangular in the cross-section of the main airflow passageway. The member 152 extends about a central axis of the airflow passageway 100 and acts to reduce the angle of expansion of air flowing through this passageway. The sheet metal member is formed with multiple bends so that its transverse cross-section goes from round at the inlet 96 to rectangular (see FIG. 3). The member 152 also increases the performance of the outlet duct apparatus 22 from the standpoint of velocity regain in the air flow.

The downstream end of baffle member 154 is arranged to meet the nose 129 of the outer splitters 112, preferably in the centre of this nose as shown in FIG. 6. It will thus be appreciated that air entering the inlet 96 at the point 160 is forced to flow on the outside of the baffle member 154 and once it reaches the outer splitter 112, is forced to flow on the outside thereof.

Figure 4:
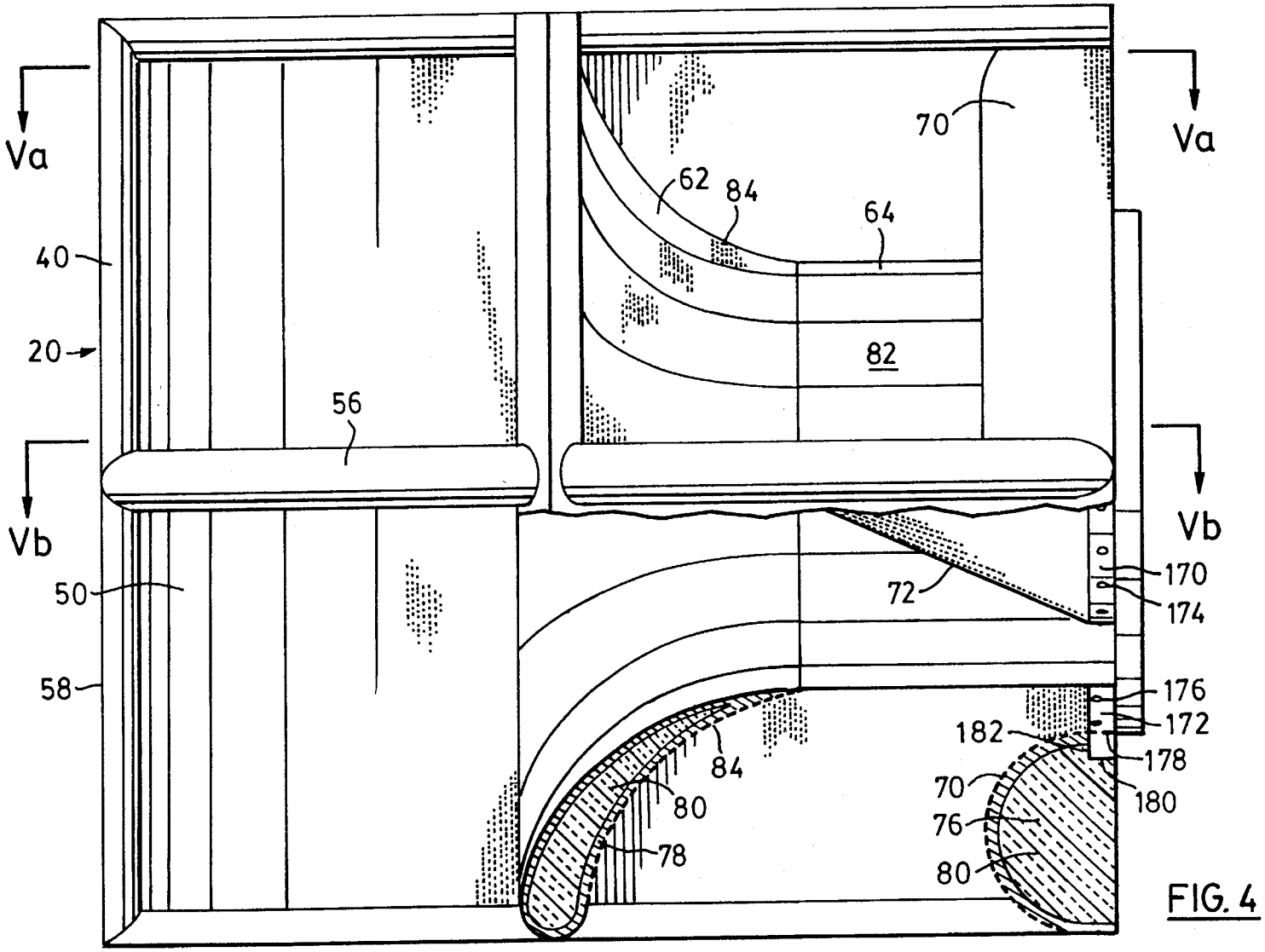
FIG. 4 is a side elevational view, partly in cross-section, taken in the direction of the arrow 4 shown in FIG. 2 showing the air duct inlet structure (in the lower half, a central interior wall has been broken away to reveal an inner air passage and a cone member)

Both the inlet duct apparatus 20 and the outlet duct apparatus 22 are preferably provided with resonator means for reducing the noise created by the operation of the fan unit, particulary peak blade passage frequency noise. In each duct unit, this resonator means comprises one or two hollow resonator chambers located adjacent the one inlet or outlet that is adapted for connection to the fan unit. As shown in FIGS. 4, 5*a* and 5*b*, in the inlet duct apparatus 20, there are two resonator chambers 170 and 172, each of which is provided with a number of holes 174, 176. The use of only one resonator chamber is also possible. Each of these chambers is enclosed by chamber walls including a peripheral wall which contains the holes 174 and 176. The chamber 172 is annular extending around the outside of the air passageway 48 while the chamber 170 is a flat, circular chamber having a diameter equal to that of the wide end of the perforated plate that forms conical member 72. Thus, the chamber 170 is encircled by the air passageway. In each case, the peripheral wall that contains the holes 174 and 176 faces the airflow passageway. Also, as shown in FIG. 4 and 5, the annular chamber 172 is defined by four walls including inner and outer circumferential walls 178 and 180, radially extending sidewall 182, and the rear wall 60 of the housing. In a preferred embodiment, the chamber walls are made of 16 gauge sheet metal and are imperforate except for the aforementioned holes 174, 176. In one preferred embodiment wherein the outside diameter of the annular outlet is 55 inches, the annular chamber 172 had 23 holes each measuring one inch in diameter spaced evenly about the circumference of the chamber. The outside diameter of the chamber 172 was 61 inches and its height was 3 inches. In this same embodiment, the circular chamber 170 had a diameter of 28 inches, a width of 2⅝th inches and 23 holes of the same one inch size. Two resonator chambers were used in the inlet duct unit because the annulus area at the outlet was treated as two annular areas with each being treated as a separate duct. Thus the chamber 170 is provided for the inner annular area while the chamber 172 is provided for the outer annular area. The total volume of the two chambers and the number of holes adds up to the required volume and holes for a single duct of the same size.

Turning now to the resonator chamber of the outlet duct apparatus 22, this chamber 184 is located at the wide end of the conical air flow defining member 104. It is a flat, circular resonator chamber similiar to the above described chamber 170. The chamber 184 is surrounded by the annular airflow passageway and evenly distributed about its circumference are a number of holes 186. In one preferred embodiment of the outlet duct apparatus wherein the outer diameter of the annular passageway at the inlet 96 was 4'7", the chamber 184 had an outside diameter of 21 inches and a width of 5⅛th inches. In this embodiment there were 20 holes, each having a diameter of 1¼ inch.

The resonators 170, 172 and 184 incorporated into the air duct apparatus of the invention provide means for changing the acoustic impedance of the air supply system. These resonator chambers act as additional noise control elements. The transmission loss of a resonator installed in an air duct having a cross sectional area $S_1$ is given by the following formula:

$$L_{TL} = 10\log_{10}\left[1 + \frac{\alpha + 0.25}{\alpha^2 + \beta^2(f/f_0 - f_0/f)^2}\right]\text{dB}$$

where $\alpha$=resonator resistance (dimensionless)=$S_1R_5/A_0\rho c$ $\beta$=resonator reactance (dimensionless)=$S_1c/2\pi f_o V$ $S_1$=area of main duct, $m^2$ $R_5$=flow of resistance in resonator tubes, mks rayls V=volume of resonator, $m^2$ $A_0$=total aperture area, $m^2$ $f_o$=resonance frequency, Hz $\rho$=density of gas, $kg/m^3$ c=speed of sound, m/sec $S_1$ here is the size of the annular open area at the outlet or inlet in the case of an annular airflow passageway. The total aperture area $A_0$ is obtained by simply multiplying the number of small holes (174 or 176) into the chamber by the area of each hole. Thus, the selected size and number of holes is not critical but as a practical matter, the holes should not be too small and it is preferred that they be at least ½ inch in diameter.

The density of gas p is simply the density of the gas or air that is flowing through the duct unit. It is a preselected density based on the design parameters of the system. The above-mentioned resonator chambers were constructed to attenuate fan blade passage frequencies in the 237 Hz range based on a fan unit with eight blades operating at 1775 R.P.M.

Using this formula, one can obtain the necessary information for calculating the details of a resonator chamber useful in a particular air supply duct system. These details include volume, throat diameter and acoustic resistance. It will be appreciated that the size and arrangement of the resonator chamber to be used and the number of holes in the peripheral wall will vary depending upon the frequency of the noise created by the fan unit which is to be reduced.

In a preferred embodiment, the space between the internal wall 102 and the external sidewall 92 of the outlet duct apparatus 22 contains a number of partition walls indicated at 190 which can be vertical walls extending from top to bottom of the unit. The arrangement and spacing of these walls can vary depending upon the particular structural support required. The space between these walls 190 is filled with the aforementioned glass fibre insulation and the partitions 190 help to support same. They also support the interior wall 102 which is made of relatively thin sheet metal.

In a preferred embodiment of outlet duct apparatus 22, the density of the sound absorbing material packed between the interior walls and the exterior walls of the housing is varied along the length of the air flow passageway in order to increase sound attenuation by the apparatus. One can obtain optimum performance in this unit if the acoustic impedance of the silencer walls is kept within a certain range of values. In particular, the flow resistivity of the dissipative or sound absorbing material should have a value given by the following equation:

$$R = 6.6\ (\text{duct dimension})(\text{design frequency})/(d)\ \text{MKS rayls}/m$$

In this equation, the letter R is the flow resistivity, a factor that varies according to the density of the sound absorbing material used. The letter d is the thickness of the sound absorbing material at a selected location along the length of the airflow passageway. The duct dimension referred to is the width or diameter of the airflow passageway at the selected location and the design frequency is the frequency of the sound which the duct apparatus is made to absorb or attenuate. The dimension d is normally constrained to yield 50% open area of the silencer. In other words, the thickness of the sound absorbing material adjacent a particular location along the duct should be at least 50% of the immediately adjoining airflow passageway. In order to obtain optimum performance, the flow resistivity must be altered to suit the particular application and required duct arrangement. For sound absorbing materials commonly used in air duct silencers, the flow resistivity is given by the following equation: $R=K(\text{bulk density})^{1.53}$ wherein K stands for a constant that would depend on the particular material used.

Figure 9:
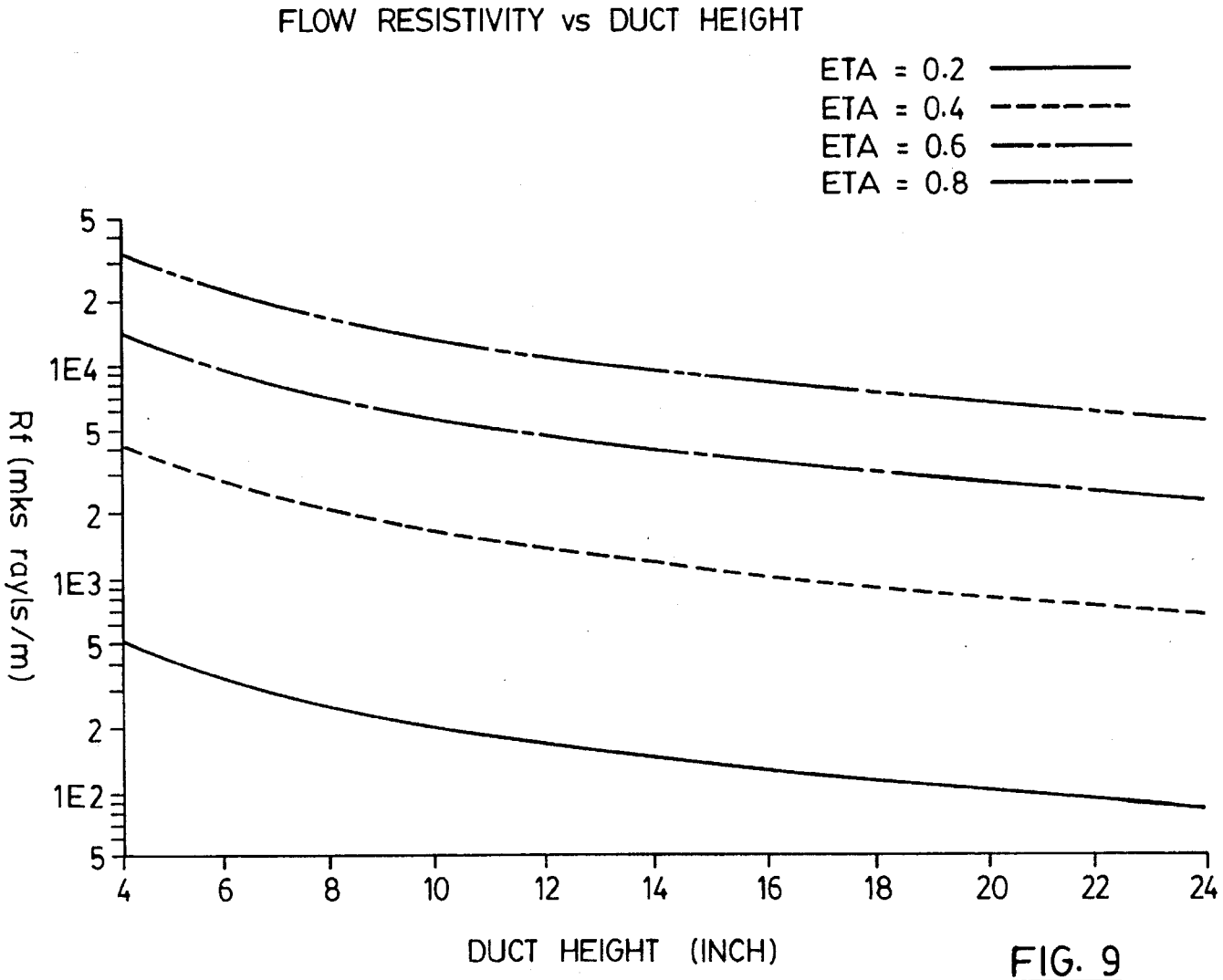
FIG. 9 is a graph or chart plotting flow resistivity versus duct height, which design chart can be used to select the flow resistivity for the sound absorbing material.

It will be appreciated that the flow resistivity of a given material can be increased by increasing the packing density. The design chart shown in FIG. 9 of the drawings can be used to select the proper value of flow resistivity. This procedure can be used to maximize the silencer's performance at a specific frequency or to provide a wide band of virtual constant attenuation.

In the particular preferred embodiment of an outlet duct apparatus that is shown in FIG. 6, the above method for determining optimal flow resistivity of the sound absorbing material was used and this procedure resulted in the use of low density acoustical filler having a density of 0.8 lbs per cubic foot in the compartment 200 located closest to the inlet 96 and extending between the end wall 94 and the first partition wall 190. The acoustical filler in the remaining, smaller compartments, had a higher density of 1.2 lbs per cubic foot. In other words, this higher density was used from the first of the partition walls 190 to the outlet end of the unit. In this particular preferred embodiment constructed by the applicant, the depth of the first compartment containing the lower density filler was two feet and the remaining compartments had a total depth of five feet. The width of the housing for this outlet duct apparatus was twelve feet. The diameter of the inlet opening of the unit was 4'7".

FIG. 6 is drawn substantially to scale so that all the dimensions of the various components and sections of this unit can be seen from the drawing.

In this unit, as indicated earlier, the density of the acoustic filler in the splitters is also varied. In particular, in each of the splitters 112 and 114 of this preferred embodiment, the density of the filler in the nose area was 1.6 lbs per cubic foot while the density of the filler in the remainder of the splitter was 1.2 lbs per cubic foot.

It will be seen that in this particularly preferred embodiment of the outlet duct apparatus, the density of the sound absorbing material for the entire length of the airflow passageway does not exceed 2 lbs per cubic foot. This compares to conventional air flow silencers where the density of the sound absorbing material is substantially higher throughout the unit, typically in the 3 lbs per cubic foot range.

A test was conducted on behalf of the applicant wherein an 84,000 CFM (cubic feet per minute) axial flow flan unit was connected to an inlet silencer and an outlet silencer constructed in accordance with the invention. In this test, heat exchanger coils and filters were installed on the inlet unit and filters on the outlet unit. In order to provide some load to the fan, additional filter media was installed. Under these operating conditions, the pressure rise across the fan was measured to be 1.5 inch water gauge with a nominal delivery of 84,000 CFM. Sound level readings were taken with a calibrated B & K 2204 sound level meter connected to an octave filter set. Sound pressure levels were converted to sound power levels using the standard method of area corrections. Measurement locations were selected around the entire unit. A microphone was placed four inches from the unit under test, assurring that the conversion from sound pressure to sound power could be performed with errors of the order of 0.5 dB. The results are summarized in the following Table 1.

TABLE 1

Measured Sound Power M&I Heat Transfer 84,000 CFM Unit

| Hz | Fan (Woods data) | Fan Casing | Inlet Silencer | Outlet Silencer |
|---|---|---|---|---|
| 31.5 | | 95 | 90 | 92 |
| 63 | 108 | 92 | 87 | 91 |
| 125 | 110 | 99 | 87 | 85 |
| 250 | 116 | 103 | 95 | 90 |
| 500 | 114 | 96 | 97 | 84 |
| 1,000 | 112 | 90 | 94 | 84 |
| 2,000 | 108 | 85 | 90 | 80 |
| 4,000 | 102 | 83 | 90 | 72 |
| 8,000 | 96 | 82 | 85 | 73 |

It is evident from these results that the fan casing is the dominate radiator at low frequencies and that the inlet silencer radiates most of the high frequency energy. Some of the high frequency noise is generated by airflow through small gaps. The inlet system in the test was not sealed because of the need to disassemble it after the test. These gaps and the panels would of course be sealed when the unit tested is installed at an actual operating site. The acoustic energy passing through the silencer suffers additional attenuation as it travels down the air ducts. Using typical performance data from ducting and diffusers, one can expect NC35 in a 4,000 cubic foot room with 30 air exchanges per hour or NC28, if there are 6 air exchanges per hour. It will be understood that this system, as tested, is constructed for installation in an enclosure inside a mechanical room of a building. The wall construction of a typical enclosure normally has an STC rating of 25. Thus, the sound transmitted from the unit into the mechanical room will result in sound level equivalent to NC60.

Figure 10:
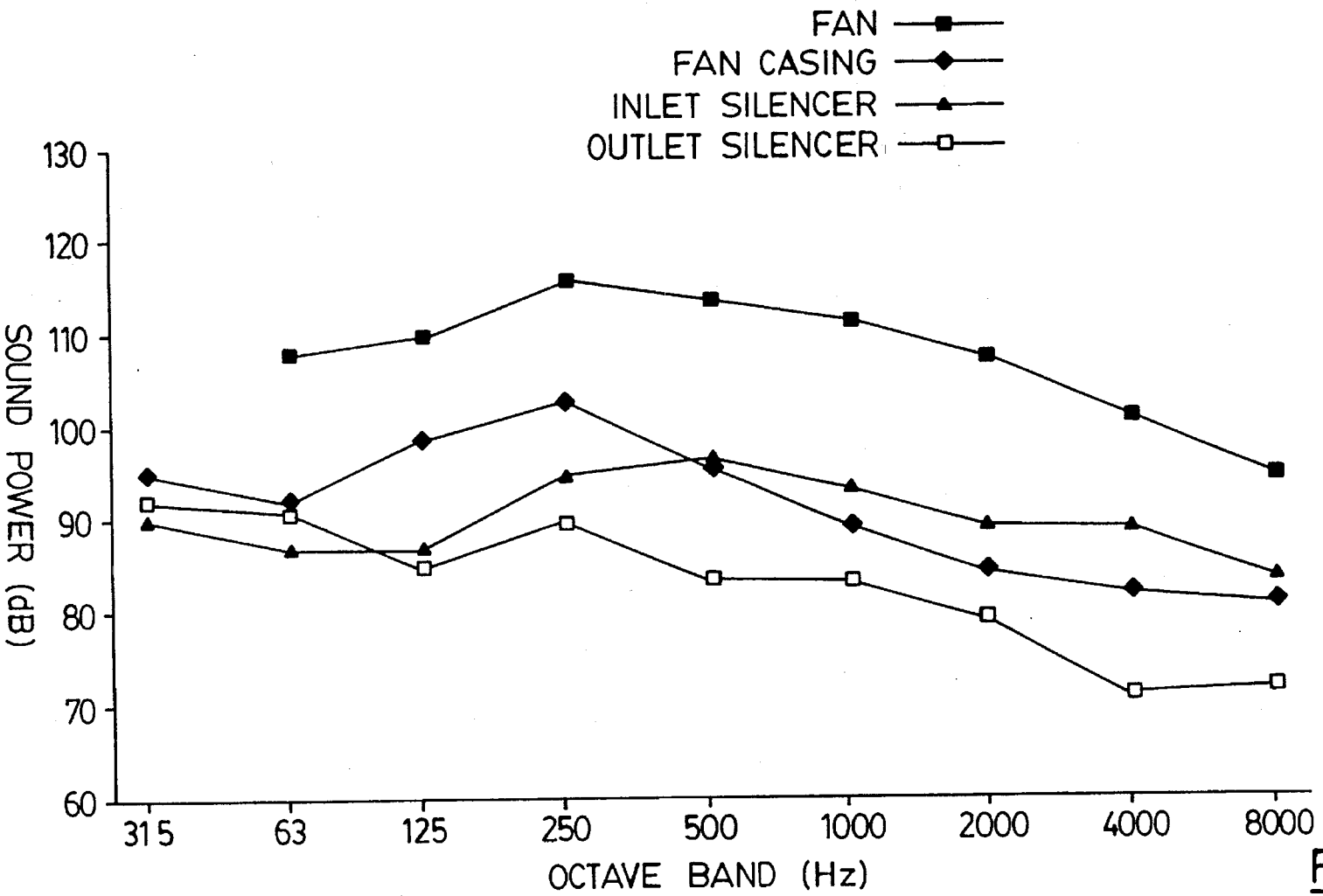
FIG. 10 is a graph plotting sound power (dB) against the octave band (Hz) and showing the results of tests conducted with an inlet silencer and outlet silencer constructed in accordance with the invention.

FIG. 10 is a graph which plots sound power against octave bands. This graph is a plot of the test results listed in the above Table 1.

It will be understood by one skilled in this art that the type of duct structure shown in FIG. 6 with two series of splitters can also be used to construct an inlet duct apparatus/silencer. If such an inlet duct/silencer is constructed, it will be understood that the splitters are modified so that they converge from the air inlet of the air duct unit towards the fan and the round nose of each splitter is arranged on the upstream side in the air flow passageway, the pointed end being at the downstream side. A diffusing baffle member is not required in an inlet duct silencer of this type.

It will be further appreciated by those skilled in the art that an outlet duct silencer similar to the inlet duct silencer of FIGS. 2 and 3 could be constructed if desired, that is in this type of outlet duct silencer the air passageways would extend through a substantial curve, for example, 90 degrees. There can be a single passageway curving in one direction or two air flow passageways curving in two opposite directions. The splitters used in this outlet duct silencer would have a circular quadrant shape.

As illustrated in FIGS. 2 and 3, in a preferred embodiment the interior wall 52 is fitted with a projecting extension member 192 which is wedge shaped as shown. This can be made of imperforate 16 gauge sheet metal and, in one embodiment, it has a horizontal length of 18 inches. This extension can be located within adjacent coil mounting frames which are part of air conditioning units indicated at 194 and 196 in FIG. 1.

The advantages of the applicant's improved duct inlet apparatus and duct outlet apparatus will be apparent from the above detailed description. Both have very good sound attenuation characteristics for both high frequency and low frequency sounds. The splitters or dividers in both duct apparatus 20 and 22 also provide for a uniform or even airflow within the airflow passageway. In case of the duct inlet apparatus 20, the use of both vertical and horizontal splitters or dividers helps to assure that each section of the fan inlet gets an equal amount of air. The outlet 46 of the apparatus 20 is divided into equal areas by solid metal dividers. The apparatus 20 provides a shallow bell arrangement with a large turning radius for the air flow. The apparatus 20 has advantages over the use of a deep bell construction which could cause pressure losses, flow separation and unequal flow distribution. In some cases, the use of a deep bell in this situation could even cause the fan to stall.

It will be apparent to one skilled in the construction of air supply units and systems that various modifications and changes could be made to the above described air supply duct apparatus without departing from the spirit and scope of this invention. Accordingly, all such modifications and changes as fall within the scope of the appended claims are intended to be part of this invention.

We therefore claim:

1. A sound attenuating duct unit suitable for placement at an outlet or an inlet of an air supply fan unit for a building or other large structure, said duct unit comprising:

a housing having side walls surrounding a main airflow passageway, a circular air inlet at one end thereof, and a rectangular air outlet in one of said side walls or at an end of the housing opposite said one end, said air inlet or said air outlet of said housing being respectively adapted for placement next to said outlet or said inlet of said fan unit, an internal wall of said housing providing a gradual transition in the transverse cross-section of said main airflow passageway from circular to rectangular; and at least first and second series of splitters with the splitters of each series being spaced apart to form smaller air passageways and being mounted side-by-side in a row, said second series being positioned downstream in said airflow passageway relative to said first series and staggered relative to said first series in a direction generally transverse to the direction of air flow in said main passageway, wherein said splitters contain sound attenuating material.

2. A sound attenuating duct unit according to claim 1 wherein said splitters are straight, elongate members extending from one side of said main airflow passageway to an opposite side thereof.

3. A sound attenuating duct unit according to claim 1 wherein said side walls of said housing contain sound attenuating material which surrounds said main airflow passageway.

4. A sound attenuating duct unit according to claim 1 wherein each splitter is formed substantially with perforated sheet metal which covers the sound attenuating material contained in the splitter.

5. A sound attenuating duct unit according to claim 1 wherein the splitters in said first series have a maximum transverse width that is substantially the same as the transverse width of the smaller air passageways formed between adjacent splitters of said second series and wherein the first and second series are so staggered that a direct open line of sight from said air inlet to said air outlet is substantially prevented.

6. A sound attenuating duct unit according to claim 1 wherein each splitter is formed substantially of perforated sheet metal which covers the sound attenuating material contained the splitter and each splitter further includes a rounded nose portion at the upstream end of the splitter, said nose portion being constructed of imperforate metal.

7. A sound attenuating duct unit according to claim 3 wherein said splitters of the second series are larger in their transverse cross-section than the splitters of the first series.

8. A sound attenuating duct unit according to claim 3 wherein each of said splitters are divided into a nose section containing sound attenuating material of a first density and a remaining section extending in a downstream direction from said nose section and containing sound attenuating material of a second density, said first density being higher than said second density.

9. A sound attenuating duct unit according to claim 8 wherein said first density is at least 1.6 lbs per cubic foot and said second density is no more than 1.2 lbs per cubit foot.

10. A sound attenuating duct unit according to claim 4 wherein each splitter contains one or more horizontal, interior support plates which are welded to said perforated sheet metal forming vertically extending exterior sidewalls of the respective splitter.

11. A sound attenuating duct unit according to claim 3 wherein said gradual transition in the transverse cross-section of the main airflow passageway takes place over a distance D starting at said circular air outlet and said distance D is substantially less than the distance between said air inlet and said air outlet of the housing.

12. A sound attenuating duct unit according to claim 3 including a diffusing baffle member rigidly mounted in said airflow passageway to provide more uniform air distribution at said air outlet, said baffle member being made of imperforate metal plate and extending about a centerline of said airflow passageway.

13. A sound attenuating duct unit according to claim 12 wherein said diffusing baffle member had a gradual change in its transverse cross-section from round at an upstream end to rectangular at an opposite downstream end.

14. A sound attenuating duct unit according to claim 3 wherein said sound attenuating material in said side walls of the housing has a density that varies along the length of said main airflow passageway in order to increase sound attenuation by the duct unit.

15. A sound attenuating duct unit according to claim 14 wherein said sound attenuating material extends from exterior side walls of said housing to said internal wall and comprises low density acoustical filler ranging in density from at least as low as 0.8 lbs per cubic foot to at least as high as 1.2 lbs per cubic foot.

16. A sound attenuating duct unit according to claim 7 wherein said splitters of the second series as seen in horizontal cross-section are both longer and wide that the splitters of the first series.

17. A sound attenuating duct unit according to claim 16 wherein each splitter is formed substantially of perforated sheet metal which covers the sound attenuating material contained in the splitter and each splitter further includes a rounded nose portion at the upstream end of the splitter, said nose portion being constructed of imperforate metal.

18. A sound attenuating duct unit according to claim 17 wherein each splitter contains one or more horizontal, interior support plates which are welded to said perforated sheet metal forming vertically extending exterior sidewalls of the respective splitter.

* * * * *